United States Patent [19]

Hills

[11] 4,223,475

[45] Sep. 23, 1980

[54] MARIONETTE WITH STRINGS WITH DIFFERENT DEGREES OF ELASTICITY

[76] Inventor: Isaac Hills, c/o Rincon Mfg. Co. Inc., 168 39th St., Brooklyn, N.Y. 11232

[21] Appl. No.: 20,623

[22] Filed: Mar. 14, 1979

[51] Int. Cl.[2] ..... A63H 7/00

[52] U.S. Cl. ..... 46/126; 46/138

[58] Field of Search ..... 46/126, 138, 139

[56] References Cited

U.S. PATENT DOCUMENTS

| | | | |
|---|---|---|---|
| 1,726,294 | 8/1929 | Greene | 46/138 X |
| 2,733,545 | 2/1956 | Guadagna | 46/126 |
| 3,024,551 | 3/1962 | Oppenheim | 46/126 X |
| 3,914,897 | 10/1975 | Schoeman | 46/126 |

*Primary Examiner*—F. Barry Shay

*Attorney, Agent, or Firm*—Kirschstein, Kirschstein, Ottinger & Cobrin

[57] ABSTRACT

A marionette which, when manipulated, has differential movement of at least one limb relative to the body of the marionette. This is accomplished by providing separate supports, i.e. strings, for the body and the limb which are characterized by being flexible and elastic manipulation strings, with the differential movement being accomplished by providing a first string for the body which has a different and preferably greater degree of elasticity, e.g. is heavier and thicker in cross-sectional area, than the second string attached to the limb. The strings extend to a common member, e.g. a ring, for placing the strings simultaneously under tension and in an extended rectilinear form. When under tension and extended, the first string assumes a rectilinear form aligned proximately with the center of gravity of the body.

8 Claims, 3 Drawing Figures

FIG. 1
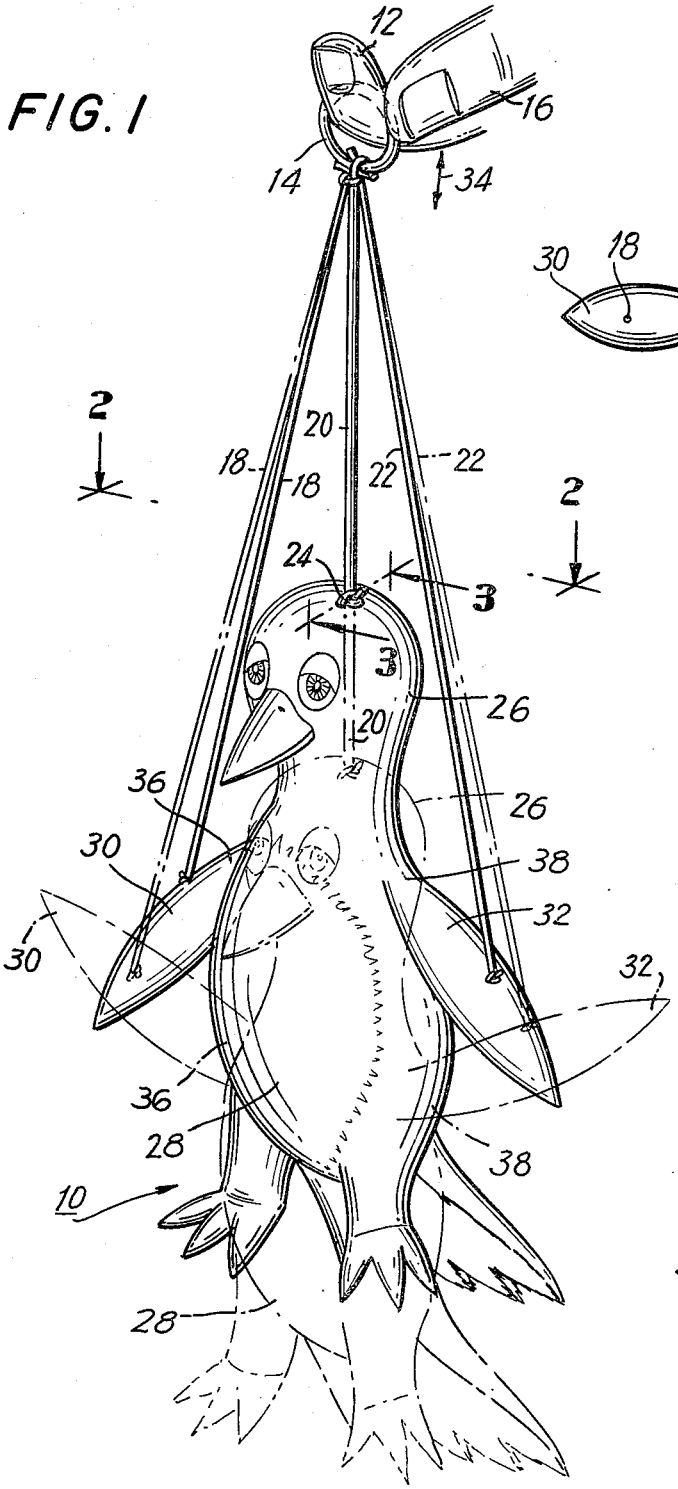
FIG. 2
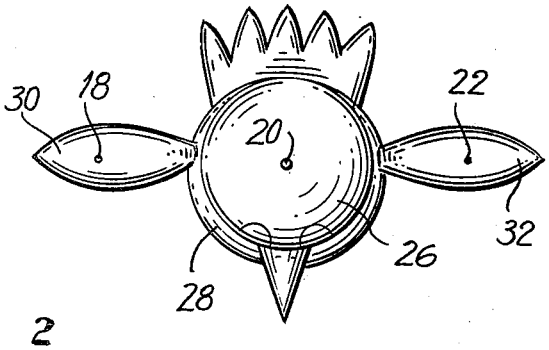
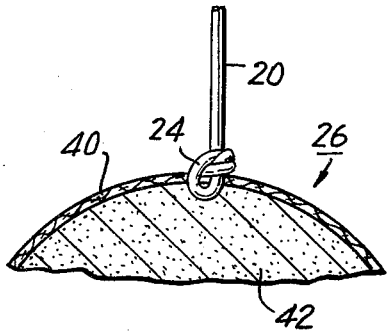
FIG. 3

MARIONETTE WITH STRINGS WITH DIFFERENT DEGREES OF ELASTICITY

BACKGROUND OF THE INVENTION

1. Field of the Invention

A marionette with differential movement of its members.

2. Description of the Prior Art

Marionettes are figure toys operated by strings. Each string is connected to a different portion of the toy, e.g. a string is connected to the body, typically to the top of an upper member mounted to the body, i.e. the head, and other strings are attached to articulated limbs of the figure toy. The strings extend to a common means for manipulation of the toy, so that life-like movement of the toy is attained, which common means typically is a rectilinear frame or a ring. Thus, in the usual marionette, there is a string connected to the head or to the center of gravity of the toy. There is a string connected to each arm and to each leg. Where there are plural strings connected to one limb, the strings may be connected to the places corresponding to joints on a human being, to wit, the wrists, elbows, ankles and knees. The marionette strings run up to a manipulating frame usually consisting of a stick of wood or a pair of crossed sticks of wood which, when held and tilted or otherwise manipulated, provides controlled pleasing and fanciful movement of the figure toy body and limbs. Among the prior art relative to marionettes and other movable figure toys may be mentioned U.S. Pat. Nos. 2,334,486; 2,454,899; 2,860,446; 3,024,551; 3,707,803 and 3,914,897.

SUMMARY OF THE INVENTION

1. Purposes of the Invention

It is an object of the present invention to provide an improved marionette.

Another object is to provide a marionette with differential movement of articulated limbs relative to the body.

A further object is to provide a marionette which, when manipulated, provides a new and pleasing mode of motion of the several members.

An additional object is to provide a marionette with a new and improved mode of suspension of the elements of the figure toy.

Still another object is to provide a marionette with differential displacement of at least one limb relative to the body of the marionette.

Still a further object is to provide a marionette in which the members are suspended by flexible elastic manipulation strings, with the main string, which when under tension and extended assumes a rectilinear form aligned proximately with the center of gravity of the body, having a different and usually greater degree of elasticity than the other ancillary strings connected to the articulated limbs.

Still an additional object is to provide a marionette in which the members are suspended by flexible elastic manipulation strings, with the main string, which when under tension and extended, assumes a rectilinear form aligned proximately with the center of gravity of the body, being heavier and thicker in cross-sectional area than the other ancillary strings connected to the articulated limbs, so that when the marionette is manipulated, differential displacement of the limbs relative to the body is attained.

An object is to provide a marionette in which a substantially equal degree of differential displacement of a plurality of limbs relative to the body is attained when the marionette is manipulated.

These and other objects and advantages of the present invention will become evident from the description which follows.

2. Brief Description of the Invention

In the present invention, the marionette is characterized by the provision of elastic manipulating strings connected between the manipulating handle and the head, body and limb portions of the marionette, with the elastic strings being dissimilar. What is preferably contemplated is to use a heavier string to connect the handle to the head or center of gravity of the marionette, and lighter strings to connect the handle to various parts of the limbs of the marionette. A heavier string requires more effort to stretch than does a lighter string. In this manner, the different parts of the marionette will respond differently to sundry movements of the handle by a manipulator, i.e. differential displacement of the limbs relative to the body is attained.

More particularly, in the present marionette the strings are not inelastic, rather they are elastic, e.g. made of rubber such as natural rubber, synthetic rubber such as neoprene or Buna-S or mixtures thereof, an elastic plastic or polymer, of the like. The string that is connected to the head or center of gravity of the marionette is usually the heaviest of the strings, and this string takes the most effort to stretch. The marionette is sufficiently heavy to partially stretch this string, for example 50% stretch. The other strings which are connected to the various limbs, e.g. various points on the arms and legs, likewise are elastic, but they are a lighter elastic. They will stretch to a greater degree, for example 75% when the marionette is manipulated. To activate the marionette, a user grasps the manipulator, preferably a common ring to which all of the strings are attached, and moves it about, e.g. up and down. The marionette will bounce, due to the elasticity of the main string. What transpires is that the limbs experience movement relative to the torso of the marionette, i.e. the limbs are differentially displaced relative to the body, because of the fact that the main string, which is attached to the body and aligned proximately with the center of gravity of the body when in a rectilinear form due to being under tension and extended, has a different and usually greater degree of elasticity than the other strings which are attached to the limbs. Thus when playing with the toy, a pleasing motion effect of the articulated limbs moving relative to the body is attained.

In summary, in the present invention, a marionette with differential movement is provided which includes a body, an upper member mounted to the body, and at least one limb extending from the body and articulatably connected thereto. A first flexible elastic manipulation string extends from the upper member, so that when under tension and extended, the first string assumes a rectilinear form aligned proximately with the center of gravity of the body. A second flexible elastic manipulation string extends from the limb to means common to both the first string and the second string. This means, typically consisting of a ring to which the free end of each string is attached, is a means for placing the strings under tension and in an extended rectilinear form. The first string has a different and preferably greater degree of elasticity than the second string, so that when the common means is manipulated, the limb is differentially displaced relative to the body.

Typically the upper member from which the first string extends is the head of the marionette. In one preferred embodiment the number of limbs is two, each of the two limbs having a respective string connected to the common manipulation means. In this embodiment of the invention, it is preferred that the strings extending from the limbs have a generally equal degree of elasticity so that both limbs are differentially displaced relative to the body by approximately the same or equal degree, when the common means is manipulated. As mentioned supra, it is preferred that the common means for manipulation of the marionette be a ring, with the free end of each string being attached to the ring; however, the common means for manipulation, i.e. for placing the strings under tension and in an extended rectilinear form, may alternatively consist of any of the other manipulator configurations mentioned supra. It is preferred that the configuration of the strings which is provided in order to attain a greater degree of elasticity in the first string than in the other strings should consist of furnishing a first string which is heavier and thicker in cross-sectional area than the second and any other strings, this being attained typically by providing strings with a circular cross-sectional dimension, with the first string having a greater diameter than the other strings. However, alternative modes of providing differential degrees of elasticity may be provided in practice. One such mode is to furnish a main first string composed of a different material of construction than the other string or strings.

The present improved marionette provides several salient advantages. Because of the differential displacement of the limbs relative to the body, a new motion effect is attained in the art of marionettes. The present marionette is easy and simple to manipulate, typically by holding the toy via the aforementioned ring and moving the ring up and down. This resulsts in bouncing motion of the marionette, with concomitant differential displacement of the limbs relative to the body, which is both pleasing and amusing. Thus the present marionette is fun to play with. The present marionette is simply and cheaply constructed, and may be mass produced at low cost thus providing pleasure to young and old alike.

The invention, accordingly, consists in the features of construction, combination of elements and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention:

FIG. 1 is a perspective view of one embodiment of the invention, namely, a marionette figure toy resembling a fanciful bird;

FIG. 2 is a sectional plan view taken substantially along the line 2–2 of FIG. 1; and FIG. 3 is a partial sectional elevation view taken substantially along the line 3—3 of FIG. 1.

DETAILED DESCRIPTION OF THE PREFERRED EMBODIMENTS

Referring now to the FIGS., a marionette 10 is manually supported from above by the fingers of the user, i.e. a forefiner 12 extends through a ring 14 is held in place by a thumb 16. From the ring 14, in accordance with the present inention, three flexible elastic manipulation strings 18, 20 and 22 depend downwards. As shown, the strings 18, 20 and 22 are under tension and extended, so that they assume a rectilinear form. The three strings 18, 20 and 22 extend from a common attachment to the ring 14 to individual discrete lower attachments to individual members of the marionette 10. The principal and center string 20, as can be seen from FIGS. 1 and 2, is heavier and thicker in cross-sectional area than the ancillary strings 18 and 22, so that the string 20 has a different and greater degree of elasticity then the strings 18 and 22. The string 20 constitutes a first string as discussed supra and as claimed. Thus, the string 20 extends to attachment 24 proximately at the center of the top of head 26 of the marionette 10, the head 26 being an upper member mounted to the body 28 of the marionette 10. As is evident from FIGS. 1 and 2, the string 20 in its extended rectilinear form is aligned proximately with the center of gravity of the body 28.

The ancillary flexible elastic manipulation strings 18 and 22 extend from upper common attachment to the ring 14, to lower individual attachments to the respective limbs 30 and 32 of the marionette 10, the limbs 30 and 32 extending laterally from the body 28 and being articulatably connected to the body 28.

As can be seen from the phantom outline in FIG. 1, viewed in conjunction with the full outline in FIG. 1, when the marionette is played with and activated by manipulation of the ring 14, e.g. by manually providing an upwards and downwards movement of the ring 14 as indicated by the two-headed arrow 34, the marionette 10 being suspended from the ring 14, the articulated limbs 30 and 32 are displaced relative to the body 28, i.e. the simulated bird marionette 10 appears to flap its simulated wings consisting of the limbs 30 and 32. This relative motion, which constitutes differential displacement of the limbs 30 and 32 relative to the body 28, is repeated and continues as long as manipulation of the toy, as indicated by the arrow 34, is kept up. As shown in full outline, when the marionette 10 is at the top of its travel path, the limbs 30 and 32 extend laterally downwards and outwards from their respective articulated connections 36 and 38 to the body 28, while as shown in phantom outline, when the marionette 10 is at the bottom of its travel path, the limbs 30 and 32 extend laterally upwards and outwards from their respective articulated connections 36 and 38 to the body 28. Thus the simulation of the flapping of the wings 30 and 32 of the bird marionette 10 is attained. Similar attractive motion effects can be attained with alternative marionettes simulating a human, i.e. a humanoid marionette, an animal such as a primate, e.g. a monkey or a chimpanzee, or even a plant or a flower, in which latter instance the petals of the flower would alternately fold and unfold simulating the closing and opening of the flower.

As shown in FIG. 1, the ancillary strings 18 and 22 are of a generally equal degree of elasticity, having equal lengths, so that both of the limbs 30 and 32 are differentially displaced relative to the body 28 by a generally equal degree, when the ring 14 is manipulated as indicated by the arrow 34.

FIG. 3 shows a typical mode of attachment of a string to a member of the marionette, i.e. the attachment 24 connects string 20 to the outer cloth covering 40 of the head 26. The inside of the head 26 is stuffed with padding or foamed plastic 42 consisting of cotton batting, cellulose, excelsior, foamed polyurethane or rubber, or other suitable material.

It thus will be seen that there is provided an article of manufacture which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A marionette with differential movement which comprises a body, an upper member mounted to said body, at least one limb extending from said body and articulatably connected thereto, a first flexible elastic manipultion string, said first string extending from said upper member so that when under tension and extended, said first string assumes a rectilinear form aligned proximately with the center of gravity of said body, and a second flexible elastic manipulation string, said second string extending from said limb to means common to both said first string and said second string for placing said strings under tension and in an extended rectilinear form, said first string having a different degree of elasticity than said second string, so that when said common means is manipulated, said limb is differentially displaced relative to said body.

2. The marionette of claim 1 in which the upper member is a head.

3. The marionette of claim 1 in which the number of limbs is two, each of said two limbs having a respective string connected to the common manipulation means.

4. The marionette of claim 3 in which the strings extending from the limbs are of a substantially equal degree of elasticity, so that both limbs are differentially displaced relative to the body by a substantially equal degree, when said common means is manipulated.

5. The marionette of claim 1 in which the common means is a ring, the free end of each string being attached to said ring.

6. The marionette of claim 1 in which the strings are composed of a rubber selected from the group consisting of natural rubber, neoprene and Buna-S.

7. The marionette of claim 1 in which the first string is heavier and thicker in cross-sectional area than the second string.

8. The marionette of claim 1 in which the first string has a greater degree of elasticity than the second string.

* * * * *